US011717461B2

(12) United States Patent
Song et al.

(10) Patent No.: US 11,717,461 B2
(45) Date of Patent: Aug. 8, 2023

(54) PALM-SUPPORTED FINGER REHABILITATION TRAINING DEVICE AND APPLICATION METHOD THEREOF

(71) Applicant: SOUTHEAST UNIVERSITY, Nanjing (CN)

(72) Inventors: Aiguo Song, Nanjing (CN); Jianwei Lai, Nanjing (CN); Huijun Li, Nanjing (CN); Hong Zeng, Nanjing (CN); Baoguo Xu, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 315 days.

(21) Appl. No.: 17/293,448

(22) PCT Filed: Mar. 21, 2019

(86) PCT No.: PCT/CN2019/079092
§ 371 (c)(1),
(2) Date: May 12, 2021

(87) PCT Pub. No.: WO2020/098197
PCT Pub. Date: May 22, 2020

(65) Prior Publication Data

US 2021/0401657 A1 Dec. 30, 2021

(30) Foreign Application Priority Data

Nov. 13, 2018 (CN) ..... 201811347019.8

(51) Int. Cl.
*A61H 1/02* (2006.01)

(52) U.S. Cl.
CPC ..... *A61H 1/0288* (2013.01); *A61H 2201/018* (2013.01); *A61H 2201/1207* (2013.01);
(Continued)

(58) Field of Classification Search
CPC ..... A61H 1/02; A61H 1/0285; A61H 1/0288; A61H 2201/165; A61H 2205/065; A61H 2205/067; B25J 9/0006; B25J 13/02
(Continued)

(56) References Cited

U.S. PATENT DOCUMENTS

2010/0305717 A1* 12/2010 Tong ..... A63B 21/4019 623/64
2018/0177666 A1* 6/2018 Tsui ..... A61H 1/0288

FOREIGN PATENT DOCUMENTS

CN 106112987 A * 11/2016 ..... B25J 15/08
CN 108478389 A * 9/2018 ..... A61H 1/0218
(Continued)

OTHER PUBLICATIONS

Translation of CN-108478391-A. Accessed from Espacenet on May 12, 2023. (Year: 2018).* Translation of JP-2018108359-A. Accessed from Espacenet on May 12, 2023. (Year: 2018).*
(Continued)

*Primary Examiner* — Valerie L Woodward
*Assistant Examiner* — Paige Kathleen Bugg
(74) *Attorney, Agent, or Firm* — CBM Patent Consulting, LLC

(57) ABSTRACT

A palm-supported finger rehabilitation training device comprises a mounting base, a finger rehabilitation training mechanism mounted on the mounting base, and a driving mechanism for driving the finger rehabilitation training mechanism; wherein the finger rehabilitation training mechanism comprises four independent and structurally identical combined transmission devices for finger training corresponding to a forefinger, a middle finger, a ring finger and a little finger of a human hand, respectively, and the mounting base is provided with a supporting surface capable of supporting a human palm; wherein each combined trans-
(Continued)

mission device for finger training comprises an MP movable chute, a PIP fingerstall, a DIP fingerstall and a connecting rod transmission mechanism; a force sensor is provided to acquire force feedback information to determine and control force stability, and a space sensor is provided to acquire space angle information to control space positions of fingers in real time.

8 Claims, 9 Drawing Sheets

(52) U.S. Cl.
CPC ..... *A61H 2201/1463* (2013.01); *A61H 2201/5061* (2013.01)

(58) Field of Classification Search
USPC ..... 601/4, 5
See application file for complete search history.

(56) References Cited

FOREIGN PATENT DOCUMENTS

| | | | | | |
|---|---|---|---|---|---|
| CN | 108478391 | A | * | 9/2018 | ..... A61H 1/0288 |
| CN | 110101549 | A | * | 8/2019 | ..... A61H 1/0285 |
| CN | 110711110 | A | * | 1/2020 | ..... A61H 1/0288 |
| JP | 2018108359 | A | * | 7/2018 | ..... A61H 1/0288 |
| WO | WO-2017145136 | A1 | * | 8/2017 | ..... A61F 2/583 |

OTHER PUBLICATIONS

Translation of CN-106112987-A. Accessed from Espacenet on May 12, 2023. (Year: 2016).*
Translation of CN-110711110-A. Accessed from Espacenet on May 12, 2023. (Year: 2020).*
Translation of CN-110101549-A. Accessed from Espacenet on May 12, 2023. (Year: 2019).*
Translation of CN-108478389-A. Accessed from Espacenet on May 12, 2023. (Year: 2018).*

* cited by examiner

PALM-SUPPORTED FINGER REHABILITATION TRAINING DEVICE AND APPLICATION METHOD THEREOF

TECHNICAL FIELD

The present invention relates to a rehabilitation training device for finger paralysis caused by cerebral stroke, and particularly relates to a fixed palm-supported exoskeleton rehabilitation training hand.

BACKGROUND

Cerebral stroke is a disease that causes pathological changes in cerebral artery and venous systems due to various reasons. Hands are important organs of humans and are indispensable parts of life and work. For hand paralysis caused by the cerebral stroke, related researches have shown that 30% of patients can regain normal function after certain rehabilitation trainings. In a traditional treatment, the patient is treated by a special doctor who performs rehabilitation massage training on the patients. However, this treatment depends on the experience and knowledge of the doctor, and the training effects vary greatly among different doctors. Due to the limited time and intensity of treatments, doctors are not able to maintain a consistently high level of the treatments, and treatments effects vary due to the individual variability.

The exoskeleton training device can provide certain rehabilitation trainings for patients. Different patients can utilize the input module on the training device to set certain parameters, and different parameters are adapted to different patients, which can help the patients to perform rehabilitation trainings in an adaptive mode.

Chinese Patent No. CN103750976A discloses a three-degree-of-freedom exoskeleton finger rehabilitation robot, and Chinese Patent No. CN103767856A discloses a wearable five-finger rehabilitation manipulator. These devices have been useful for the rehabilitation training of fingers, but there are still some limitations: (1) the two devices are manipulators mounted above fingers, which put more stress on the hands of patients and can easily cause secondary injuries; (2) the two devices provide certain rehabilitation trainings for human fingers, but finger movement angle is small, and rehabilitation training effect is limited. Therefore, there is a need for a training device that does not put stress on the fingers, such as a device that can be placed directly on a table or other locations. Not only can the device satisfy the training to the patient without causing injury to other parts of the patient body, but also the device has great training angle space, such that better training effects can be achieved.

SUMMARY

To address limitations in the prior art, the present invention provides a palm-supported finger rehabilitation training device and an application method thereof.

In order to achieve the aforementioned objective, the present invention adopts the following technical scheme.

A palm-supported finger rehabilitation training device comprises a mounting base, a finger rehabilitation training mechanism mounted on the mounting base, and a driving mechanism for driving the finger rehabilitation training mechanism; wherein the finger rehabilitation training mechanism comprises four independent and structurally identical combined transmission devices for finger training corresponding to a forefinger, a middle finger, a ring finger and a little finger of a human hand, respectively, and the mounting base is provided with a supporting surface capable of supporting a human palm; wherein each combined transmission device for finger training comprises a metacarpophalangeal (MP) movable chute, a proximal interphalangeal (PIP) fingerstall, a distal interphalangeal (DIP) fingerstall and a connecting rod driving mechanism, wherein:

the MP movable chute is formed by extending along an end of the supporting surface and is an arc structure with two circular arc chutes, wherein the circular arc chutes can limit the movement track of the connecting rod transmission mechanism; the connecting rod transmission mechanism comprises a connecting rod a, a connecting rod b and a connecting rod c; wherein the connecting rod a is provided for connecting one circular arc chute of the MP movable chute and a transmission arm of the connecting rod b, the connecting rod b is connected with the connecting rod a through the circular arc chute provided in the connecting rod a, and the connecting rod a and the connecting rod b are respectively provided with the PIP fingerstall and the DIP fingerstall at fingerstall mounting positions; the connecting rod c is a three-section structure comprising a front section, a middle section and an end section connected sequentially, wherein the front section of the connecting rod c is connected with a power output end of the driving mechanism, two ends of the middle section of the connecting rod c are respectively connected with the front section of the connecting rod c and the end section of the connecting rod c, one end of the end section of the connecting rod c is connected with the other circular arc chute of the MP movable chute, and the other end is connected with the transmission arm of the connecting rod b; a space sensor is mounted in the middle of the front section of the connecting rod c through a protective housing, and a force sensor is mounted in the DIP fingerstall;

when transmitted by the connecting rod transmission mechanism and driven by the driving mechanism, the PIP fingerstall and the DIP fingerstall have two limit states, namely a first limit state and a second limit state;

when the PIP fingerstall and the DIP fingerstall are in the first limit state, the fingers fixed by the PIP fingerstall and the DIP fingerstall are in the same plane as the human palm;

when the PIP fingerstall and the DIP fingerstall are in the second limit state, the fingers fixed by the PIP fingerstall and the DIP fingerstall can bend inward relative to the human palm;

the driving mechanism comprises four motors disposed in the mounting base, wherein each motor is provided with a motor reduction gearbox mounted in a protective base of the motor reduction gearbox and a motor encoder.

In the palm-supported rehabilitation training device, the lower part of the mounting base has mounting holes connected and fixed with four motors; the upper middle of the supporting surface has a circular arc curved surface adapted to the palm shape; the upper end of the mounting base has four mounting positioning bases connected with four MP movable chutes in four combined transmission devices for finger training, respectively.

In the palm-supported finger rehabilitation training device, two through holes are provided at the ends of the transmission arm of the connecting rod a, and a stainless steel slotted pin roll is passed from one side through a bearing and the through holes sequentially and then is fixed on the other side with a circlip, such that the connecting rod a is connected with one circular arc chute of the MP movable chute;

two through holes are provided at the ends of the transmission arm of the connecting rod b, and a stainless steel slotted pin roll is passed from one side through a bearing and the through holes sequentially and then is fixed on the other side with a circlip, such that the connecting rod b is connected with a circular arc chute provided in the connecting rod a by one through hole, and the connecting rod b is connected with the end section of the connecting rod c by the other through hole.

In the palm-supported finger rehabilitation training device, four protective bases of motor reduction gearboxes are vertically mounted with a protective base of forefinger motor reduction gearbox and a protective base of ring finger motor reduction gearbox, and horizontally mounted with a protective base of middle finger motor reduction gearbox and a protective base of little finger motor reduction gearbox.

In the palm-supported finger rehabilitation training device, the motor reduction gearboxes are mounted at a power output end of the motors, and the motor encoders are mounted at a power input end of the motors, and the motor encoders are connected to a motor driving board together with a motor power cord, and the motor driving board is connected with a single-chip microcomputer module.

In the palm-supported finger rehabilitation training device, the single-chip microcomputer module also comprises a pulse width modulated (PWM) module and a space position information acquisition module, wherein the PWM module is connected with a motor driving module, the motor driving module is connected with the motor encoder, and the space position information acquisition module is connected with the space sensor.

In the application method of the palm-supported finger rehabilitation training device, the palm-supported finger rehabilitation training device has three working modes selected according to the rehabilitation degree of a patient, namely passive rehabilitation training, active-passive rehabilitation training and active rehabilitation training, wherein:

step I: initializing a system, powering on a single-chip microcomputer, starting without enabling a PWM module and a torque output by a motor, and selecting a mode;

step II: starting to select a calibration mode, assisting fingers in need of rehabilitation training to wear a rehabilitation training device to perform reciprocating motion, acquiring the position information of a space sensor by the single-chip microcomputer through a space position information acquisition module, recording the maximum and minimum values of the stretching and grasping of the fingers, and saving data and exiting the calibration mode by pressing buttons on the single-chip microcomputer;

step III: selecting a mode again selecting the passive rehabilitation training:

when the output angle of the space sensor is less than the calibrated maximum value, the PWM module is enabled, the force applied to the fingers on the device is kept stable by the force sensor based on a force stability control algorithm, the control torque is output by the motor which rotates upward at a constant speed, the current speed deviation is obtained by calculating the deviation between the speed feedback from the motor and the current set speed, and the current speed output is obtained using a proportional-integral-derivative (PID) control algorithm; when the output angle of the motor is greater than the calibrated maximum value, the motor is changed to rotate downward to the calibrated minimum value, then the motor is changed to rotate upward, and the above actions are repeated;

selecting the active-passive rehabilitation training:

when the output angle of the space sensor is less than the calibrated maximum value, the PWM module is enabled, the force stability is determined and controlled by the force sensor, and the control torque is output by the motor which rotates upward at a constant speed to the calibrated maximum value;

when the patient starts to move fingers autonomously, the torque output by the motor is zero, and when the patient stops moving fingers, the motor starts to output torque to help the patient to complete a rehabilitation training cycle;

selecting the active rehabilitation training:

when the output angle of the space sensor is less than the calibrated maximum value, the PWM module is enabled, the force stability is determined and controlled by the force sensor, and the constant torque is output by the motor which rotates upward at a constant speed to the calibrated maximum value;

when the patient moves fingers downward autonomously, the output torque of the patient knuckles is acquired by the force sensor, and the output torque of the motor is obtained using the force stability control algorithm; at the beginning, the patient can move fingers, but fails to move the fingers to the calibrated minimum position due to certain resistance of the motor output, and after repeat training, the patient can move fingers autonomously.

In the application method of the palm-supported finger rehabilitation training device, the force stability control algorithm is a PID control algorithm, specifically, the force sensor is used to acquire the torque applied to the fingers, the deviation between the set torque and the actual torque is calculated, the product of torque deviation and a program set value $K_p$ is added to the product of integral of the torque deviation and a program set value $K_i$, and the result is used as the motor output.

The present invention provides a palm-supported finger rehabilitation training device and an application method thereof; and the device is suitable for helping patients with hand paralysis caused by cerebral stroke to perform active and passive rehabilitation training, and has the following beneficial effects.

(1) In the palm-supported finger rehabilitation process, the palm is kept flat in the treatment device, and the support of the palm will not put pressure on the wrist, and will not cause secondary injuries to the wrist and other parts while ensuring the intensity of the rehabilitation training.

(2) The force sensor is used to determine and control force stability.

(3) The chutes can be used to reduce the complexity of device structure, and the four motors can be used for the stretching and grasping of fingers in a larger space, such that the rehabilitation effect of the fingers is ensured.

(4) The single-chip microcomputer and the space sensor are used to control the space position of the motors in real time, and the device features low cost, low price and easy popularization.

BRIEF DESCRIPTION OF THE DRAWINGS

In order to more clearly illustrate the embodiments of the present invention or the technical schemes in the prior art, the drawings required in the embodiments will be briefly described below. It is obvious that the drawings described below are only some embodiments of the present invention, and it is obvious for those of ordinary skill in the art that other drawings can be obtained according to the drawings without creative efforts.

Reference numbers represent different components in the above drawings, wherein 1 is mounting base, 2 is connecting rod c, 2-1 is front section of connecting rod c, 2-2 is middle section of connecting rod c, 2-3 is end section of connecting rod c, 3 is protective housing of space sensor, 4 is space sensor, 5 is MP movable chute, 6 is PIP fingerstall, 7 is connecting rod a, 7-1 is transmission arm of connecting rod a, 7-2 is fingerstall mounting position of connecting rod a, 7-3 is chute of connecting rod a, 8 is DIP fingerstall, 9 is connecting rod b, 9-1 is transmission arm of connecting rod b, 9-2 is fingerstall mounting position of connecting rod b, 10 is protective base of forefinger motor reduction gearbox, 11 is forefinger motor base, 12 is protective base of middle finger motor reduction gearbox, 13 is middle finger motor base, 14 is protective base of ring finger motor reduction gearbox, 15 is ring finger motor base, 16 is protective base of little finger motor reduction gearbox, 17 is little finger motor base, 18 is forefinger motor reduction gearbox, 19 is forefinger motor, 20 is middle finger motor reduction gearbox, 21 is middle finger motor, 22 is ring finger motor reduction gearbox, 23 is ring finger motor, 24 is little finger motor reduction gearbox, 25 is little finger motor, and 26 is force sensor.

DETAILED DESCRIPTION

The technical schemes in the embodiments of the present invention will be clearly and completely described below with reference to the drawings in the embodiments of the present invention. It is apparent that the described embodiments are only some, but not all, embodiments of the invention. Based on the embodiments in the present invention, all other embodiments obtained by those of ordinary skill in the art without making any creative effort, fall within the protection scope of the present invention.

Figure 1:
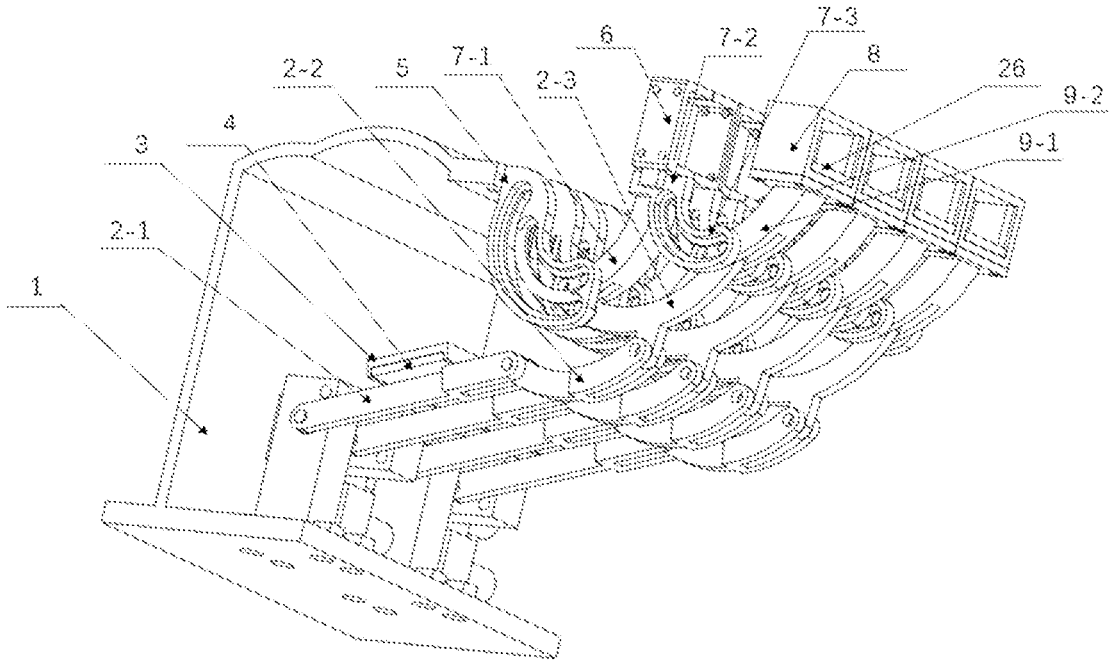
FIG. 1 is a schematic view of the overall structure of a palm-supported finger rehabilitation training device.
Figure 2:
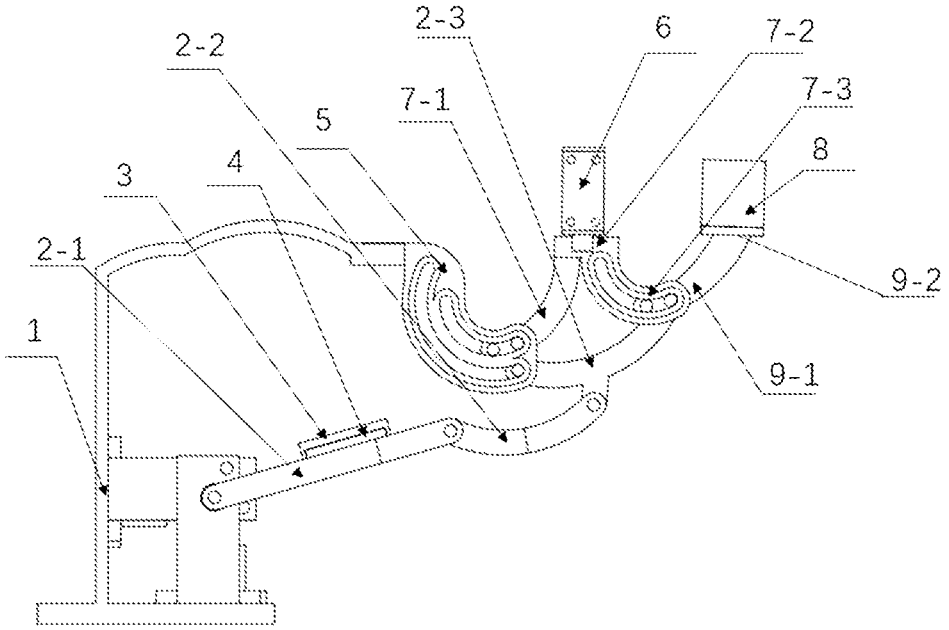
FIG. 2 is a side view of a connecting rod transmission structure of the palm-supported finger rehabilitation training device according to the present invention.
Figure 3:
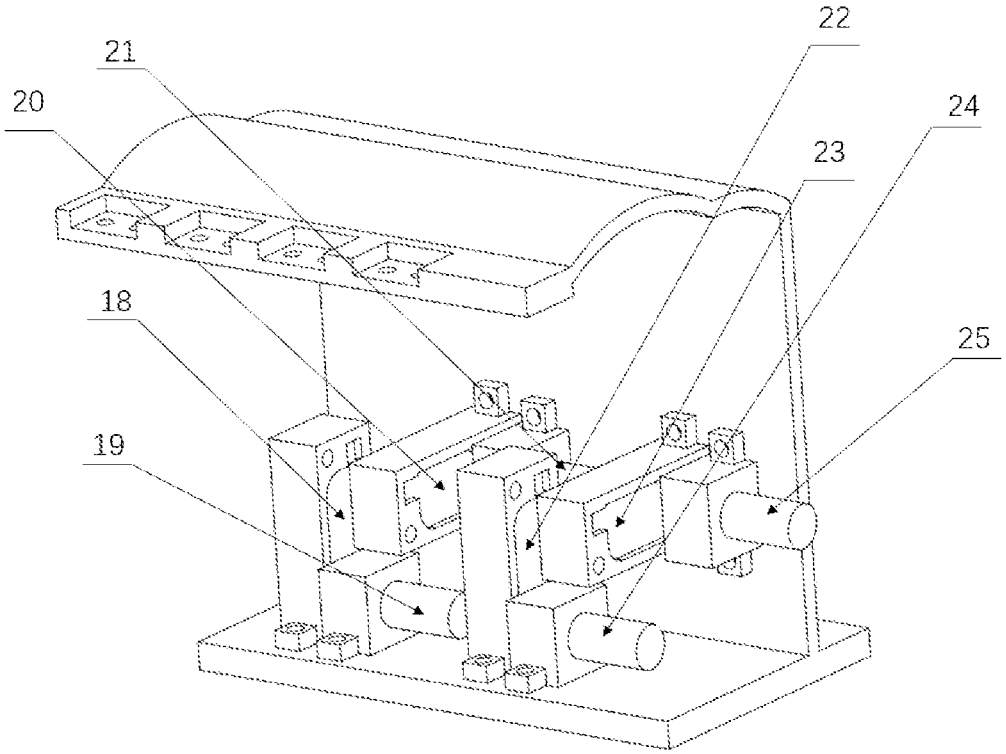
FIG. 3 is a schematic view of the structure of the palm supporting component and dynamic system of the palm-supported finger rehabilitation training device.
Figure 4:
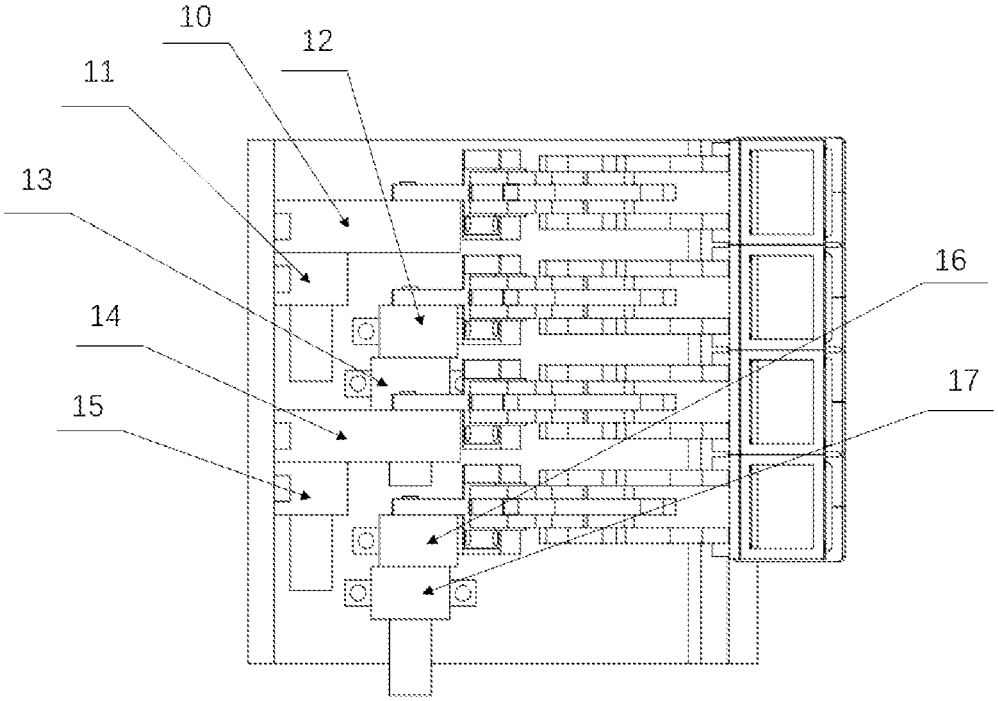
FIG. 4 is a schematic view of the structure of the four-finger component of the palm-supported finger rehabilitation training device.
Figure 5:
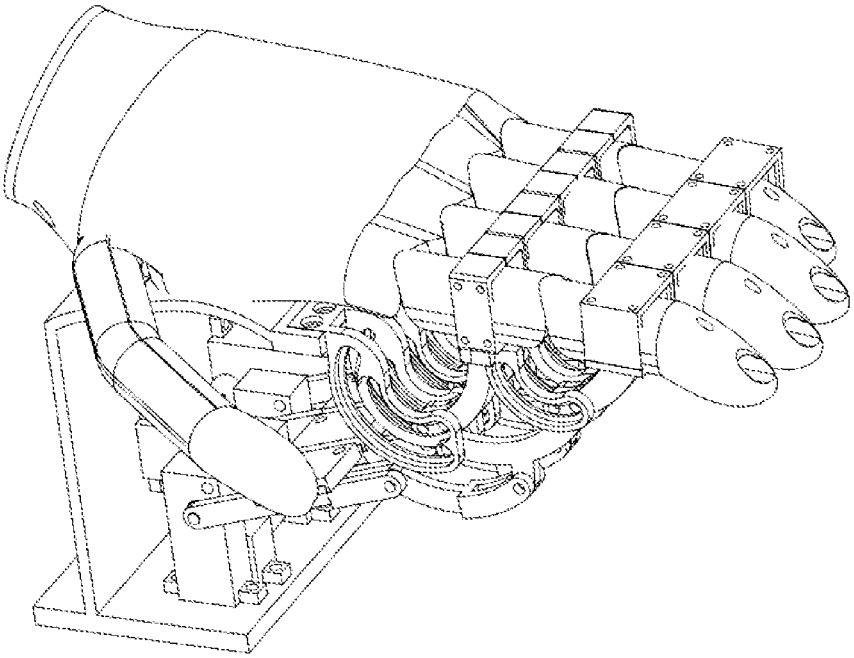
FIG. 5 is a diagram of the palm-supported finger rehabilitation training device and the application method thereof according to the present invention.
Figure 6:
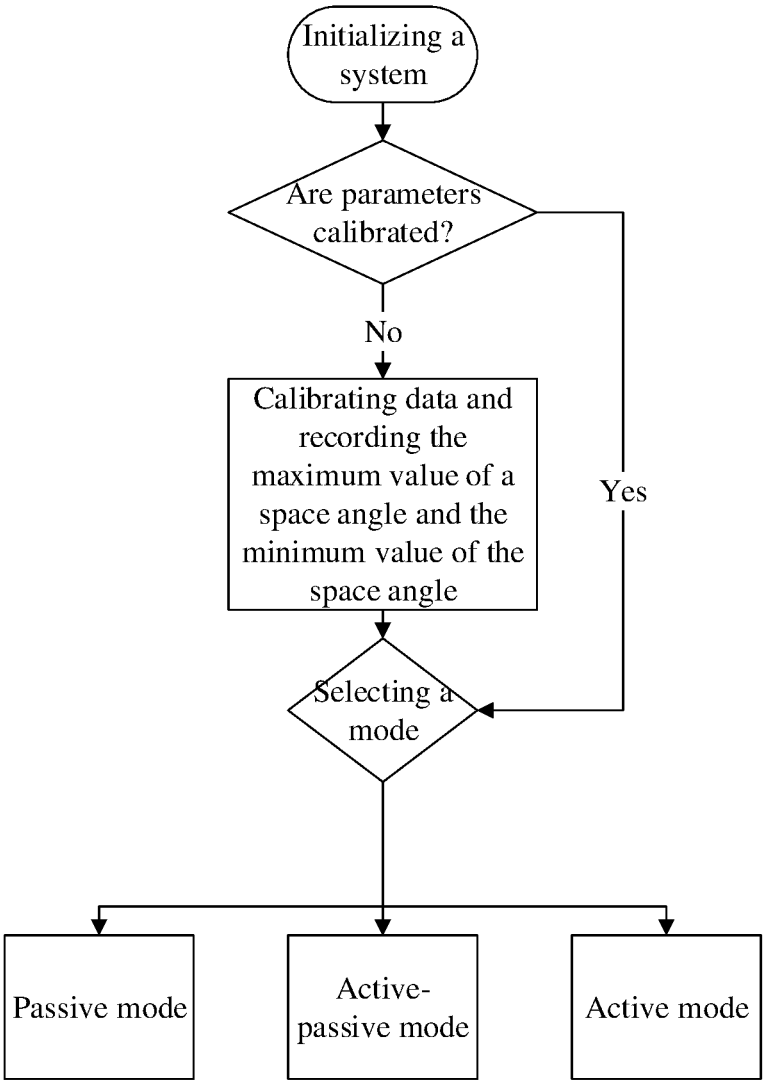
FIG. 6 is a flowchart of the general control of the palm-supported finger rehabilitation training device and the application method thereof according to the present invention.
Figure 7:
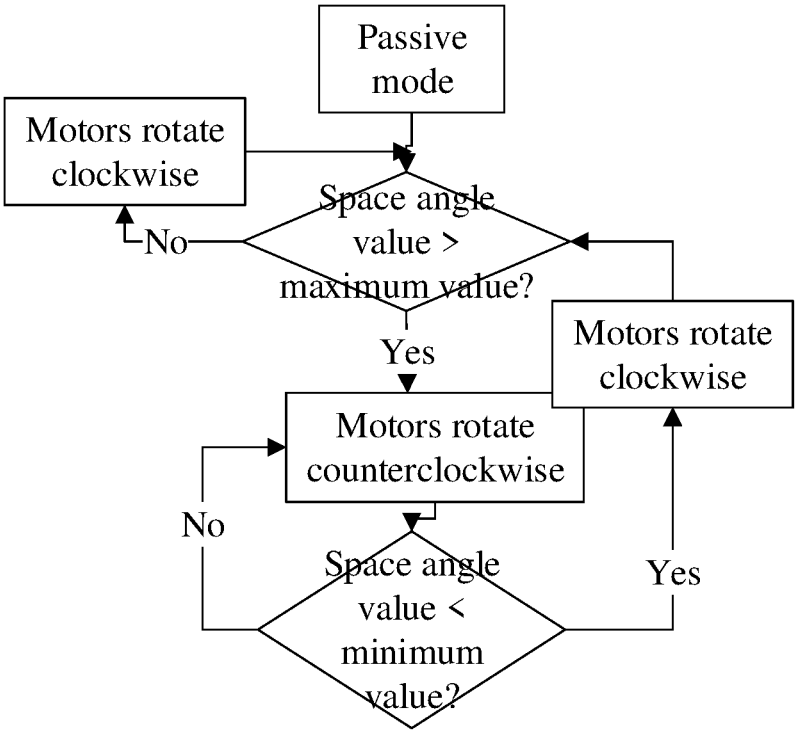
FIG. 7 is a flowchart of the passive rehabilitation control of the palm-supported finger rehabilitation training device and the application method thereof according to the present invention.
Figure 8:
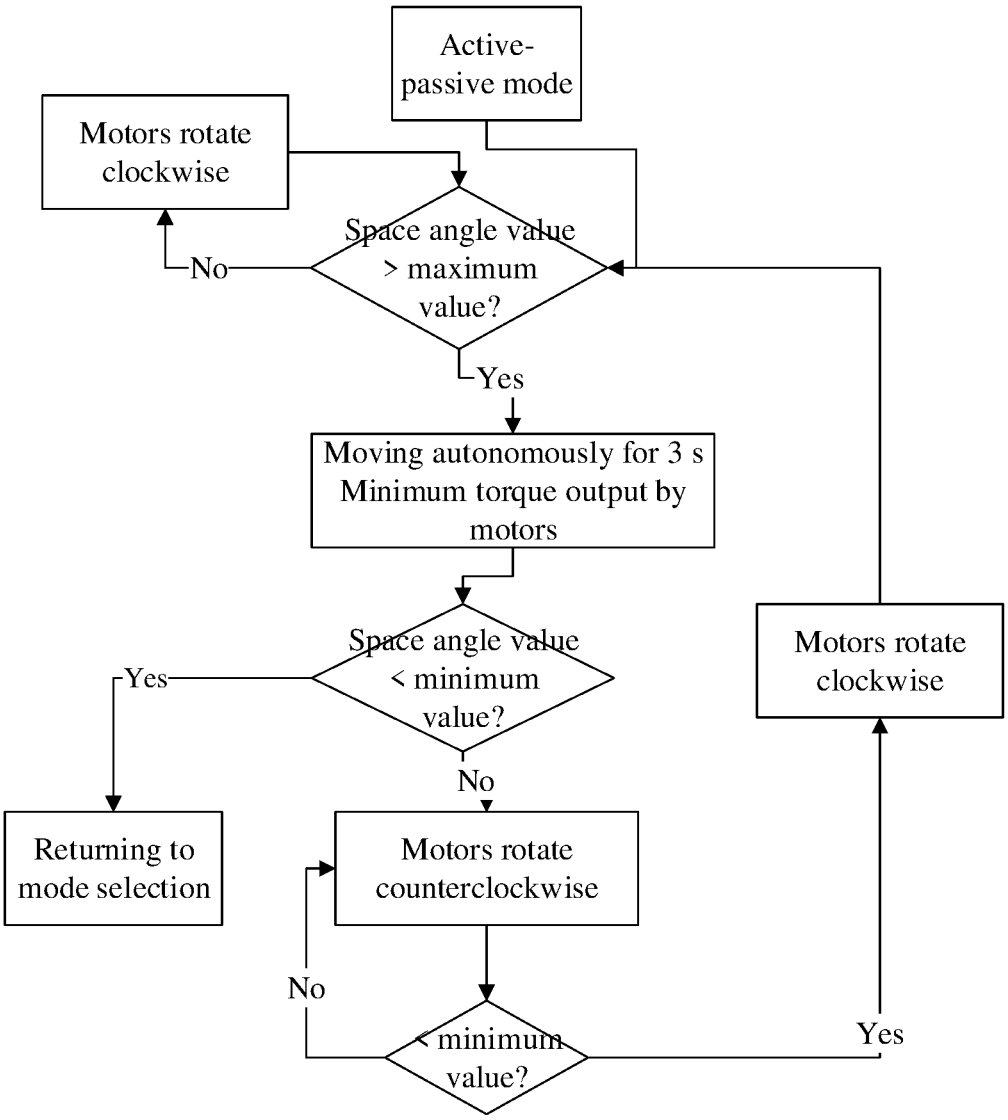
FIG. 8 is a flowchart of the active-passive combination rehabilitation control of the palm-supported finger rehabilitation training device and the application method thereof according to the present invention.
Figure 9:
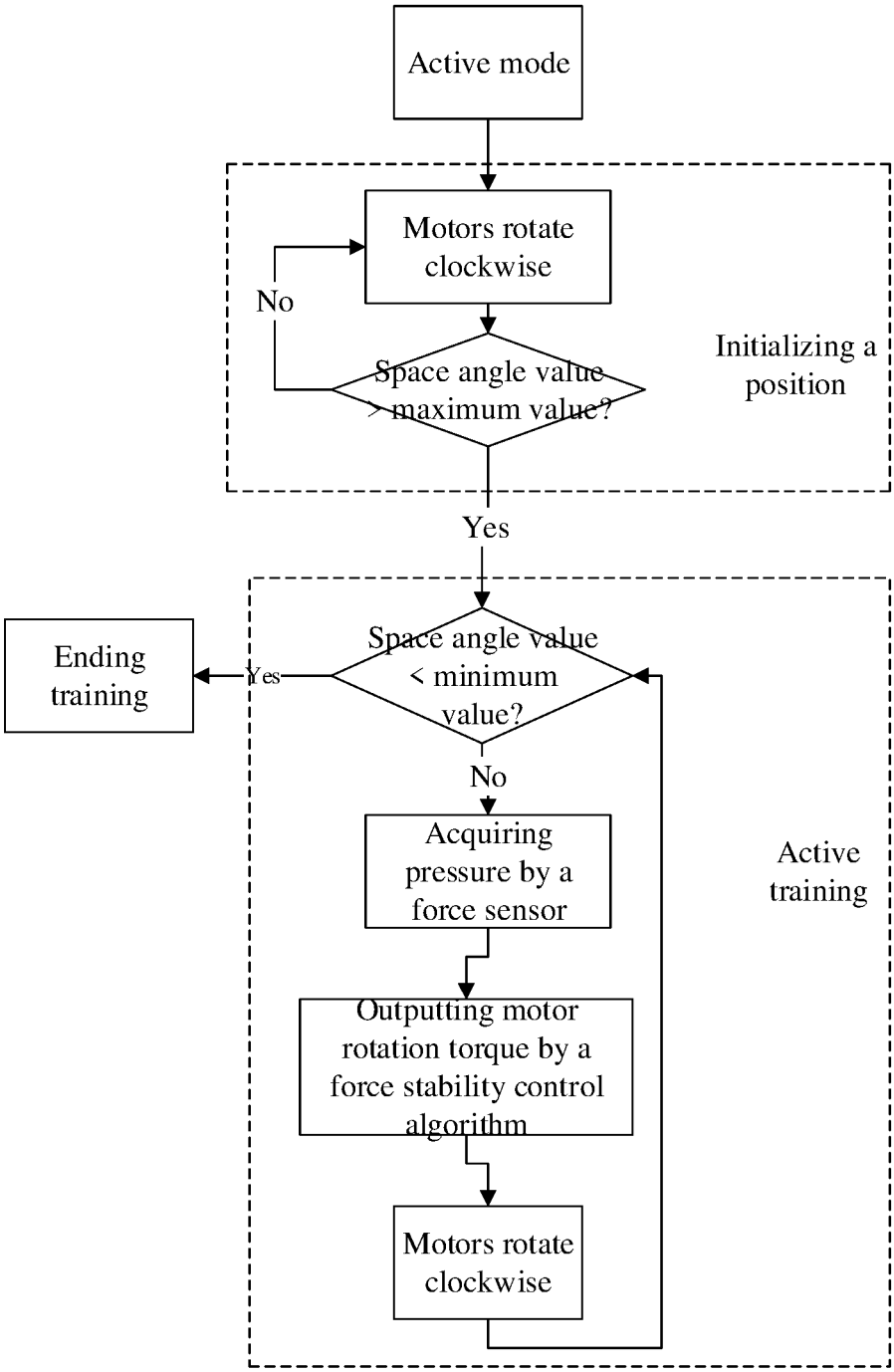
FIG. 9 is a flowchart of the main control of the palm-supported finger rehabilitation training device and the application method thereof according to the present invention.
Figure 10:
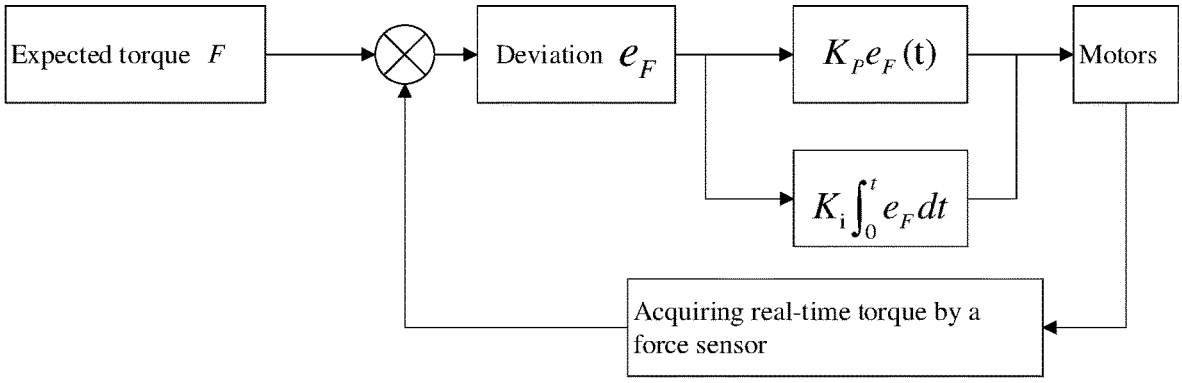
FIG. 10 is a flowchart of a force stability control algorithm of the palm-supported finger rehabilitation training device and the application method thereof according to the present invention.

As shown in FIG. 1 and FIG. 2, a palm-supported finger rehabilitation training device comprises a mounting base, a finger rehabilitation training mechanism mounted on the mounting base, and a driving mechanism for driving the finger rehabilitation training mechanism; wherein the finger rehabilitation training mechanism comprises four independent and structurally identical combined transmission devices for finger training corresponding to a forefinger, a middle finger, a ring finger and a little finger of a human hand, respectively, and the mounting base is provided with a supporting surface capable of supporting a human palm; wherein each combined transmission device for finger training comprises an MP movable chute 5, a PIP fingerstall 6, a DIP fingerstall 8 and a connecting rod transmission mechanism comprising a connecting rod a 7, a connecting rod b 9, and a connecting rod c 2.

One end of the connecting rod transmission mechanism 2 is connected with the power output end of the driving mechanism, and the other end is in linkage connection with the PIP finger stall 9 and the DIP fingerstall 10; the MP movable chute 5 is formed by extending along the end of the supporting surface and is an arc structure with two circular arc chutes, wherein the circular arc chutes can not only ensure the smooth transmission of the transmission arms within them, but also limit the movement of the connecting rod driving mechanism to the required track; the connecting rod c is a three-section structure comprising a front section, a middle section and an end section connected sequentially, wherein the front section 2-1 of the connecting rod c is connected with the power output end of the driving mechanism, two ends of the middle section 2-2 of the connecting rod c are respectively connected with the front section 2-1 of the connecting rod c and the end section 2-3 of the connecting rod c, one end of the end section 2-3 of the connecting rod c is connected with one circular arc chute of the MP movable chute 5, and the other end is connected with the transmission arm 9-1 of the connecting rod b 9; the connecting rod a 7 is used for connecting the other circular arc chute of the MP movable chute 5 with the transmission arm of the connecting rod b 9, with the PIP finger stall 6 mounted at the fingerstall mounting position; the connecting rod b 9 is connected with the connecting rod a 7 through the arc chute 7-3 provided thereon, with the DIP fingerstall 8 mounted at the mounting position.

When the palm-supported finger rehabilitation training device is mounted, the four MP movable chutes 5 are fixed to the four mounting positions of the palm supporting base, the transmission arm 7-1 of the connecting rod a is passed through the rear end of the MP movable chute 5 with bearings mounted on both sides, and a stainless steel slotted pin roll is passed through the left bearing, the left side of the MP movable chute, the transmission arm 7-1 of the connecting rod a and the right side of the MP movable chute sequentially and then is fixed with a circlip, such that the MP movable chute is connected with two holes of the transmission arm 7-1 of the connecting rod a, thereby ensuring that the transmission arm 7-1 of the connecting rod a keeps a fixed track under the limitation of the MP movable chute.

When the transmission arm 9-1 of the connecting rod b is connected with the chute 7-3 of the connecting rod a, the transmission arm 9-1 of the connecting rod b passes through the rear end of the chute 7-3 of the connecting rod a with bearings mounted on both sides, and a stainless steel slotted pin roll is passed through the left bearing, the left side of the chute 7-3 of the connecting rod a, the transmission arm 9-1 of the connecting rod b and the right side of the chute 7-3 of the connecting rod a and then is fixed with a circlip, such that the chute 7-3 of the connecting rod a is connected with two holes of the transmission arm 9-1 of the connecting rod b, thereby ensuring that the transmission arm 10-1 of the connecting rod b keeps a fixed track under the limitation of the chute 7-3 of the connecting rod a.

The connecting rod a is provided with three connecting sites, wherein a first connecting site is connected with the MP movable chute 5 through the transmission arm 7-1, a second connecting site is a fingerstall mounting base used for mounting a PIP fingerstall, and a third connecting site is connected with the transmission arm 9-1 of the connecting rod b through the chute 7-3.

The connecting rod b is provided with three connecting sites, wherein a first connecting site is connected with the chute 7-3 of the connecting rod a through the transmission arm 9-1, a second connecting site is a fingerstall mounting base used for mounting a DIP fingerstall, and a third connecting site is connected with the end section 2-3 of the connecting rod c.

The end section 2-3 of the connecting rod c is provided with three connecting sites, wherein a first connecting site is passed through the MP movable chute 5 and the transmission arm 7-1 of the connecting rod a, and a stainless steel slotted pin roll is passed through the left bearing, the left side of the MP movable chute 5, the transmission arm 7-1 of the connecting rod a, the right side of the MP movable chute 5 and the right bearing sequentially and then is fixed with a circlip; a second connecting site is passed through the chute of the connecting rod a and the transmission arm of the connecting rod b, and a stainless steel slotted pin roll is passed through the left bearing, the left side of the chute of the connecting rod a, the transmission arm of the connecting rod b, the right side of the chute of the connecting rod a and the right bearing sequentially and then is connected with a circlip; and a middle connecting site is connected with the middle section 2-2 of the connecting rod c.

The middle section 2-2 of the connecting rod c is provided with two connecting sites, wherein one connecting site is connected with the end section 2-3 of the connecting rod c, and a stainless steel slotted pin roll is passed through the left side of the middle section 2-2 of the connecting rod c, the end section 2-3 of the connecting rod c and the right side of the middle section 2-2 of the connecting rod c sequentially, and then is connected with a circlip;

the other connecting site is connected with the front section 2-1 of the connecting rod c. A space sensor is mounted in the middle of the front section of the connecting rod c through a protective housing, and a force sensor is mounted in the DIP fingerstall.

When transmitted by the connecting rod transmission mechanism and driven by the driving mechanism, the PIP fingerstall 6 and the DIP fingerstall 8 have two limit states, namely a first limit state and a second limit state. The space sensor can acquire the space angle of each finger, and the force sensor can acquire the positive pressure of the finger on the finger rehabilitation training device. When the fingers bend downward, the positive pressure between the rehabilitation training device and the four fingers is acquired by the force sensor, the force exerted on the finger on the device is kept stable by a force stability control algorithm, and the space angles of the four fingers are decreased. In the first limit state, the space angles reach the maximum value, and the fingers fixed by the PIP fingerstall and the DIP fingerstall are in the same plane as the human palm. Then the fingers are stretched, the force sensor is in the same state as the downward bending, and the space angles of the four fingers are increased. In the second limit state, the space angles reach the minimum value, and the fingers fixed by the PIP fingerstall and the DIP fingerstall can bend inward relative to the human palm.

In the palm-supported rehabilitation training device, the lower part of the mounting base has mounting holes connected and fixed with four motors; the upper middle of the supporting surface has a circular arc curved surface adapted to the palm shape; the upper end of the mounting base has four mounting positioning bases connected with four MP movable chutes in four combined transmission devices for finger training, respectively.

In the palm-supported finger rehabilitation training device, two chutes of the MP movable chute and the chute of the connecting rod a are all circular arc chutes.

The circular arc chutes can not only ensure the smooth transmission of the transmission arms within them, but also limit the movement of the transmission arm 7-1 and the transmission arm 9-1 in the connecting rod transmission mechanism under the limitation of the chutes, which can further ensure that the palm-supported finger rehabilitation training device works as expected.

For the convenience of implementation, the end section 2-3 of the connecting rod c is an approximate Y-shaped structure with an arc upper part, wherein the left upper end is connected with the MP movable chute 5, the right upper end is connected with the transmission arm 9-1 of the connecting rod b, and the lower part is connected with the middle section 2-2 of the connecting rod c.

Two through holes are provided at the ends of the transmission arm 7-1 of the connecting rod a and the transmission arm 9-1 of the connecting rod b, which are used for mounting and can keep the transmission arms in a fixed track under the limitation of the chutes.

The force stability control algorithm is a PID control algorithm, specifically, the force sensor 26 is used to acquire the torque applied to the fingers, the deviation between the set torque and the actual torque is calculated, the product of torque deviation and a program set value $K_p$ is added to the product of integral of the torque deviation and a program set value $K_i$, and the result is used as the motor output.

The present invention also provides an application method of the palm-supported finger rehabilitation training device.

The palm-supported finger rehabilitation training device has three working modes selected according to the rehabilitation degree of a patient, namely passive rehabilitation training, active-passive rehabilitation training and active rehabilitation training, wherein:

step I: initializing a system, powering on a single-chip microcomputer, starting without enabling a PWM module and a torque output by a motor, and selecting a mode;

step II: starting to select a calibration mode, assisting fingers in need of rehabilitation training to wear a rehabilitation training device to perform reciprocating motion, acquiring the position information of a space sensor by the single-chip microcomputer through a space position information acquisition module, recording the maximum and minimum values of the stretching and grasping of the fingers, and saving data and exiting the calibration mode by pressing buttons on the single-chip microcomputer;

step III: selecting a mode again selecting the passive rehabilitation training:

when the output angle of the space sensor is less than the calibrated maximum value, the PWM module is enabled, the force applied to the fingers on the device is kept stable by the force sensor based on a force stability control algorithm, the control torque is output by the motor which rotates upward at a constant speed, the current speed deviation is obtained by calculating the deviation between the speed feedback from the motor and the current set speed, and the current speed output is obtained using a PID control algorithm; when the output angle of the motor is greater than the calibrated maximum value, the motor is changed to rotate downward to the calibrated minimum value, then the motor is changed to rotate upward, and the above actions are repeated;

selecting the active-passive rehabilitation training:

when the output angle of the space sensor is less than the calibrated maximum value, the PWM module is enabled, the force stability is determined and controlled by the force sensor, and the control torque is output by the motor which rotates upward at a constant speed to the calibrated maximum value;

when the patient starts to move fingers autonomously, the torque output by the motor is zero, and when the patient stops moving fingers, the motor starts to output torque to help the patient to complete a rehabilitation training cycle;

selecting the active rehabilitation training:

when the output angle of the space sensor is less than the calibrated maximum value, the PWM module is enabled, the force stability is determined and controlled by the force sensor, and the constant torque is output by the motor which rotates upward at a constant speed to the calibrated maximum value;

when the patient moves fingers downward autonomously, the output torque of the patient knuckles is acquired by the force sensor, and the output torque of the motor is obtained using the force stability control algorithm; at the beginning, the patient can move fingers, but fails to move the fingers to the calibrated minimum position due to certain resistance of the motor output, and after repeat training, the patient can move fingers autonomously.

The principles and embodiments of the present invention have been illustrated herein using specific examples, which are presented only to help to understand the method of the present invention and core idea thereof. Meanwhile, the modifications on specific embodiments and the application range will be made by those of ordinary skill in the art according to the idea of the present invention. In summary, the content of the present specification should not be construed as a limitation of the present invention.

What is claimed is:

1. A palm-supported finger rehabilitation training device, comprising:

a mounting base, a finger rehabilitation training mechanism mounted on the mounting base, and a driving mechanism for driving the finger rehabilitation training mechanism; wherein the finger rehabilitation training mechanism comprises four independent and structurally identical combined transmission devices configured for finger training corresponding to a forefinger, a middle finger, a ring finger and a little finger of a human hand, respectively, and the mounting base is provided with a supporting surface capable of supporting a human palm; wherein each combined transmission device configured for finger training comprises a metacarpophalangeal (MP) movable chute, a proximal interphalangeal (PIP) fingerstall, a distal interphalangeal (DIP) fingerstall and a connecting rod driving mechanism, wherein:

the MP movable chute is formed by extending along an end of the supporting surface and is an arc structure with a first circular arc chute and a second circular arc chute, wherein the first circular arc chute and the second circular arc chute limit the movement of the connecting rod transmission mechanism;

the connecting rod transmission mechanism comprises a connecting rod a, a connecting rod b, and a connecting rod c; wherein the connecting rod a is provided for connecting a first circular arc chute of the MP movable chute and a transmission arm of the connecting rod b, the connecting rod b is connected with the connecting rod a through a circular arc chute provided in the connecting rod a, and the connecting rod a is positioned proximal the PIP fingerstall, and the connecting rod b is positioned proximal the DIP fingerstall at their respective fingerstall mounting positions; the connecting rod c has a three-section structure comprising a front section, a middle section and an end section connected sequentially, wherein the front section of the connecting rod c is connected with a power output end of the driving mechanism, two ends of the middle section of the connecting rod c are respectively connected with the front section of the connecting rod c and the end section of the connecting rod c, one end of the end section of the connecting rod c is connected with the second circular arc chute of the MP movable chute, and another end is connected with the transmission arm of the connecting rod b; a space sensor is mounted in a middle of the front section of the connecting rod c through a protective housing, and a force sensor is mounted in the DIP fingerstall;

when transmitted by the connecting rod transmission mechanism and driven by the driving mechanism, the PIP fingerstall and the DIP fingerstall have two limit states, a first limit state and a second limit state;

when the PIP fingerstall and the DIP fingerstall are in the first limit state, the PIP fingerstall and the DIP fingerstall are configured to position each finger in the same plane as the human palm;

when the PIP fingerstall and the DIP fingerstall are in the second limit state, the PIP fingerstall and the DIP fingerstall are configured to position each finger to bend inward relative to the human palm;

the driving mechanism comprises four motors disposed in the mounting base, wherein each motor is provided with a motor reduction gearbox mounted in a protective base of the motor reduction gearbox, and a motor encoder.

2. The palm-supported finger rehabilitation training device according to claim 1, wherein a lower part of the mounting base has mounting holes connected and fixed with each of the four motors respectively; an upper middle of the supporting surface has a circular arc curved surface adapted to a shape of the palm; an upper end of the mounting base has four mounting positioning bases connected with each of the four MP movable chutes in the four combined transmission devices configured for finger training, respectively.

3. The palm-supported finger rehabilitation training device according to claim 1, wherein two first through holes are provided at each end of a transmission arm of the connecting rod a, and a first stainless steel slotted pin roll is passed from one side of the transmission arm of the connecting rod a to another side through a first bearing and the first through holes sequentially, and then is fixed on the other side with a first circlip, such that the connecting rod a is connected with one circular arc chute of the MP movable chute;

two second through holes are provided at each end of the transmission arm of the connecting rod b, and a second stainless steel slotted pin roll is passed from one side of the transmission arm of the connecting rod b to another side through a second bearing and the second through holes sequentially, and then is fixed on the other side with a second circlip, such that the connecting rod b is connected with the circular arc chute provided in the connecting rod a by one of the second through holes, and the connecting rod b is connected with the end section of the connecting rod c by the other second through hole.

4. The palm-supported finger rehabilitation training device according to claim 1, wherein the protective bases of a forefinger motor reduction gearbox and a ring finger motor reduction gearbox are vertically mounted, and the protective bases of a middle finger motor reduction gearbox and a little finger motor reduction gearbox are horizontally mounted.

5. The palm-supported finger rehabilitation training device according to claim 1, wherein each the motor reduction gearboxes are mounted at a power output end of each of the motors respectively, and each of the motor encoders are mounted at a power input end of each of the motors respectively, and each of the motor encoders are connected to a motor driving board with a motor power cord, and the motor driving board is connected with a single-chip microcomputer module.

6. The palm-supported finger rehabilitation training device according to claim 5, wherein the single-chip microcomputer module further comprises a pulse width modulated (PWM) module, and a space position information acquisition module, wherein the PWM module is connected with a motor driving module, the motor driving module is connected with the motor encoder, and the space position information acquisition module is connected with the space sensor.

7. A method of using the palm-supported finger rehabilitation training device according to claim 1, wherein the palm-supported finger rehabilitation training device has three working modes selected according to a rehabilitation degree of a patient, wherein the three working modes include: a passive rehabilitation training, an active-passive rehabilitation training, and an active rehabilitation training, the method comprising:

a first step which includes: initializing a system, powering on a single-chip microcomputer, starting, without enabling, a pulse width modulated (PWM) module and a torque output by a motor, and selecting one of the three working modes;

a second step which includes: selecting a calibration mode, assisting the patient's fingers in need of rehabilitation training by wearing the palm-supported finger rehabilitation training device and performing reciprocating motion, acquiring a position information of a space sensor by the single-chip microcomputer through a space position information acquisition module, recording the maximum and minimum values of stretching and grasping of the patient's fingers, saving data, and exiting the calibration mode by pressing buttons on the single-chip microcomputer;

a third step including: selecting one of the three working modes again;

wherein when selecting the passive rehabilitation training, the method includes a first rehabilitation cycle comprising:

when an output angle of the space sensor is less than a calibrated maximum value, the PWM module is enabled, a force applied to the patient's fingers by the device is kept stable by the force sensor based on a force stability control algorithm, a control torque is output by the motors which rotate upward at a constant speed, a current speed deviation is obtained by calculating a deviation between a speed feedback from the motors and a current set speed, and a current speed output is obtained using a proportional-integral-derivative (PID) control algorithm; when the output angle of the motors are greater than the calibrated maximum value, the motors are changed to rotate downward to a calibrated minimum value, then the motors are changed to rotate upward, and the first rehabilitation cycle is repeated;

wherein when selecting the active-passive rehabilitation training, the method includes:

when the output angle of the space sensor is less than the calibrated maximum value, the PWM module is enabled, a force stability is determined and controlled by the force sensor, and the control torque is output by the motors which rotate upward at a constant speed to the calibrated maximum value;

when the patient starts to move their fingers autonomously, the torque output by the motors are zero, and when the patient stops moving their fingers, the motors start to output torque to help the patient to complete a second rehabilitation training cycle;

wherein when selecting the active rehabilitation training, the method includes:

when the output angle of the space sensor is less than the calibrated maximum value, the PWM module is enabled, the force stability is determined and controlled by the force sensor, and a constant torque is output by the motors which rotate upward at a constant speed to the calibrated maximum value;

when the patient moves their fingers downward autonomously, an output torque of the patient's knuckles is acquired by the force sensor, and the output torque of the motors are obtained using the force stability control algorithm; at the beginning of the active rehabilitation training, the patient is able to move their fingers, but fails to move their fingers to the calibrated minimum value due to a resistance of the motor output, and after repeated training, the patient is able to move their fingers autonomously against the resistance.

8. The method of using the palm-supported finger rehabilitation training device according to claim 7, wherein the force stability control algorithm is a PID control algorithm, wherein the force sensor is used to acquire the output torque applied to the patient's fingers, a torque deviation between a set torque and an actual torque is calculated, a product of the torque deviation and a program set value $K_p$ is added to a product of an integral of the torque deviation and a program set value $K_i$, and a result is used as the motor output.

* * * * *